US006363929B1

(12) United States Patent
Winefordner et al.

(10) Patent No.: US 6,363,929 B1
(45) Date of Patent: Apr. 2, 2002

(54) SNORKEL HAVING A SECURE YET ADJUSTABLE STRAP HOOK

(75) Inventors: Carl Winefordner; Frank Hermansen, both of Laguna Beach, CA (US)

(73) Assignee: QOS Injection Molding LLC, San Diego, CA (US)

( * ) Notice: Subject to any disclaimer, the term of this patent is extended or adjusted under 35 U.S.C. 154(b) by 0 days.

(21) Appl. No.: 09/580,609

(22) Filed: May 30, 2000

(51) Int. Cl.[7] ..... B63C 11/16

(52) U.S. Cl. ..... 128/201.11; 128/201.26; 128/201.27; 128/201.28; 128/200.29; 128/206.29; 248/125.3

(58) Field of Search ..... 128/201.11, 201.26, 128/201.27, 201.28, 200.29, 206.29; 405/186, 187; 24/457, 458; 248/122.1, 125.1, 125.3, 297.31

(56) References Cited

U.S. PATENT DOCUMENTS 5,117,817 A * 6/1992 Lin ..... 128/201.11
5,265,591 A * 11/1993 Ferguson ..... 128/201.11
5,487,379 A * 1/1996 Koshiishi ..... 128/201.11
5,529,057 A * 6/1996 Ferrero et al. ..... 128/201.11
5,622,165 A * 4/1997 Huang ..... 128/201.11
5,893,362 A * 4/1999 Evans ..... 128/201.11
6,079,410 A * 6/2000 Winefordner et al. . 128/201.11
6,085,744 A * 7/2000 Hermansen et al. ... 128/201.11
6,129,081 A * 10/2000 Wu ..... 128/201.11

* cited by examiner

*Primary Examiner*—John G. Weiss
*Assistant Examiner*—Mital Patel
(74) *Attorney, Agent, or Firm*—Leonard Tachner

(57) ABSTRACT

A snorkel with a unique strap hook and snorkel tube arrangement which permits both selective release and adjustment of the strap hook, but only when release or adjustment is desired and not by inadvertence. In a preferred embodiment, the snorkel tube is provided with a hook slide region enclosed along the tube surface by an elongated border. Inside each side of the border there is a recess for receiving rails of a strap hook having dove tail cross-section rails. The dove tail relationship between the recesses and the rails prevents inadvertent release of the strap hook from the snorkel tube. However, an opening at one end of each such recess, permits selective removal of the strap hook from the snorkel tube. Selective adjustment of the position of the strap hook is controlled by a plurality of teeth along the center of the hook slide region and a semi-flexible catch on the strap hook which nominally engages the teeth so that only when the catch is lifted off of the teeth can the strap hook be re-located along the snorkel tube.

8 Claims, 3 Drawing Sheets

SNORKEL HAVING A SECURE YET ADJUSTABLE STRAP HOOK

BACKGROUND OF THE INVENTION

1. Field of the Invention

The present invention relates generally to the field of snorkels and more specifically to a snorkel tube having an adjustable strap hook that is more securely joined to the snorkel tube and provides for selective release from the snorkel tube.

2. Prior Art

Snorkels have become an extremely popular form of water sport. By wearing a pair of goggles or mask and a snorkel, a snorkeler can observe beautiful sea flora and fauna from a vantage point near the surface while breathing without needing cumbersome and costly scuba diving equipment. In a typical snorkel and mask arrangement, the snorkel tube has a strap hook by which the snorkel tube is attached to the mask strap. However, typical prior art strap hooks for snorkel tubes, provide a number of disadvantages. One such disadvantage results from a desire to provide a strap hook which can be removed from the snorkel tube so that the mask and snorkel can be easily separated for stowing and carrying. Often, the strap hook separates from the snorkel tube when it is not desirable, such as when a snorkeler is underwater and the tube is caught on an object or otherwise yanked away from the mask. Another such disadvantage is related to the position of the strap hook on the tube. The desired position is that which accommodates both the desired position of the snorkel's mouthpiece and the most comfortable position of the mask strap. In order to permit such accommodation, the strap hook is preferably adjustable along the length of the snorkel tube. However, that adjustability is also an inconvenience when a snorkeler removes the mouthpiece permitting the strap hook to inadvertently slide along the snorkel tube, thereby requiring re-adjustment when the mouthpiece is replaced in the snorkeler's mouth.

It would therefore be highly advantageous if it were possible to provide a snorkel having an adjustable and releasible strap hook, but where adjustment along the length of the snorkel tube and release from the snorkel tube, only occurs when desired. In other words, it would be desirable to have a snorkel wherein a strap hook could be easily detached and easily adjusted in position, but is otherwise stable and secure when adjustment or release were not desired.

SUMMARY OF THE INVENTION

The present invention provides a snorkel with a unique strap hook and snorkel tube arrangement which permits both selective release and adjustment of the strap hook, but only when release or adjustment is desired and not by inadvertence.

In a preferred embodiment, the snorkel tube is provided with a hook slide region enclosed along the tube surface by an elongated border. Inside each side of the border there is a recess for receiving rails of a strap hook having dove tail cross-section rails. The dove tail relationship between the recesses and the rails prevents inadvertent release of the strap hook from the snorkel tube. However, an opening at one end of each such recess, permits selective removal of the strap hook from the snorkel tube. Selective adjustment of the position of the strap hook is controlled by a plurality of teeth along the center of the hook slide region and a semi-flexible catch on the strap hook which nominally engages the teeth so that only when the catch is lifted off of the teeth can the strap hook be re-located along the snorkel tube.

OBJECTS OF THE INVENTION

It is therefore a principal object of the present invention to provide a snorkel having a selectably adjustable and releasible strap hook which will not release or relocate inadvertently.

It is another object of the invention to provide a snorkel having a strap hook which is securely connected to the snorkel tube for limited relative movement therebetween.

It is yet another object of the invention to provide a snorkel having a strap hook which employs a positive catch release operation to permit adjustment of the strap hook along the snorkel tube.

It is still another object of the invention to provide a snorkel having a strap hook which is slidably connected to the snorkel tube by a dove tail arrangement of rails and recesses.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
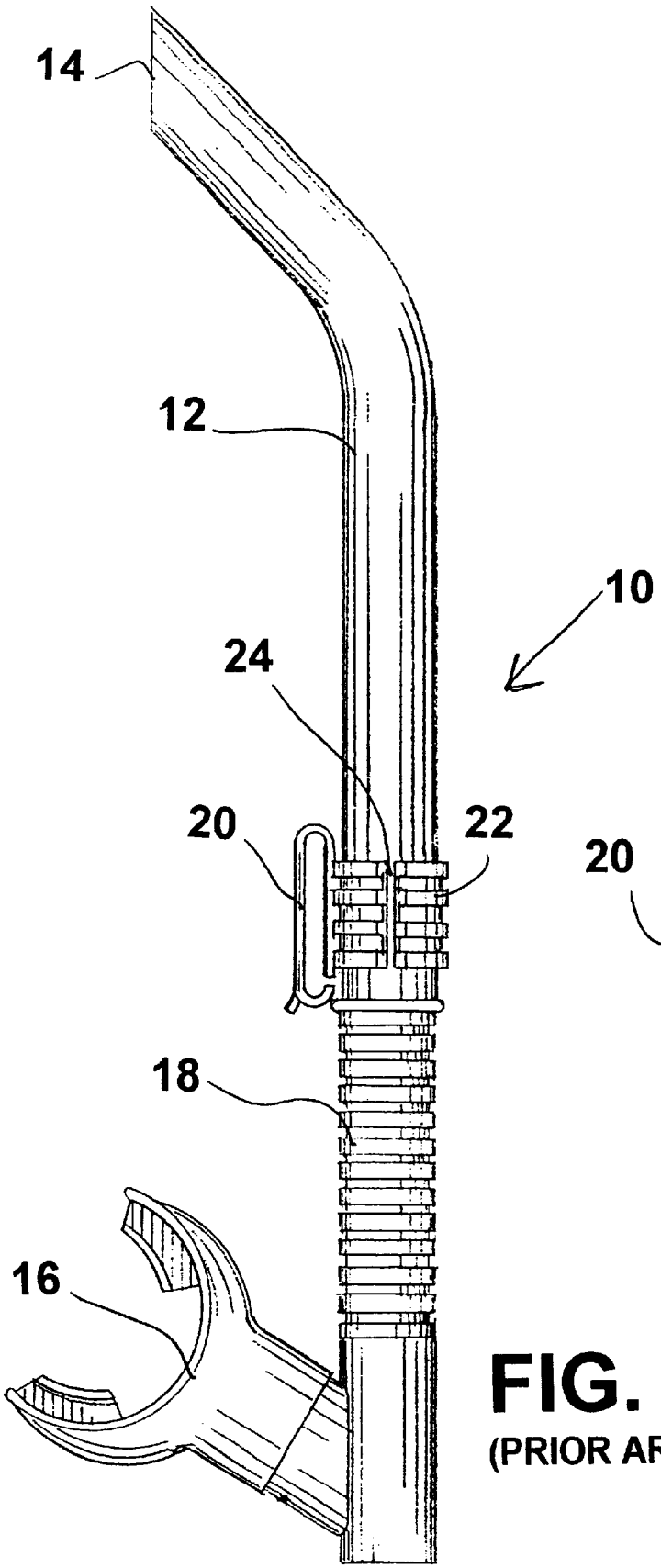
FIG. 1 (PRIOR ART)
FIG. 1 is a prior art drawing showing a snorkel having a conventional strap hook.
Figure 2:
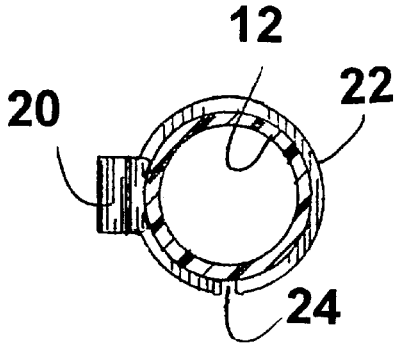
FIG. 2 (PRIOR ART)
FIG. 2 is a top view of the prior art strap hook of FIG. 1.
Figure 3:
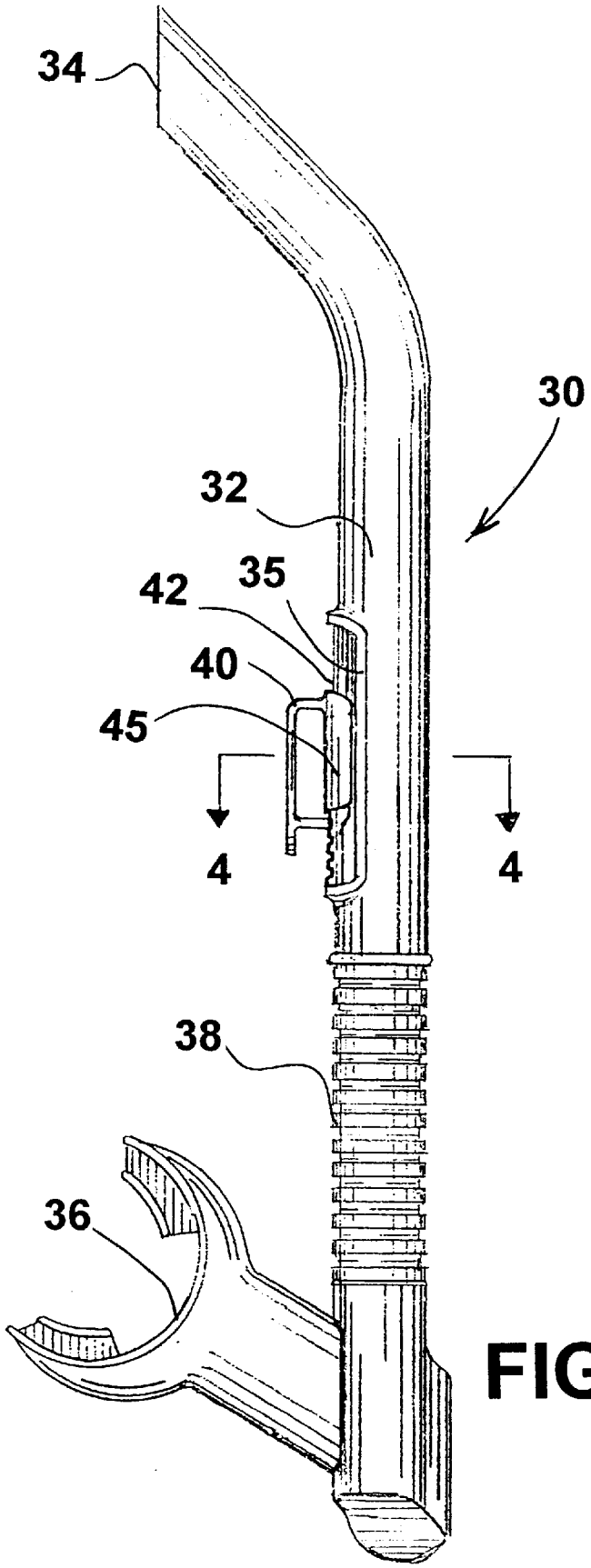
FIG. 3 is a drawing similar to FIG. 1 but showing the strap hook and snorkel tube arrangement of the preferred embodiment of the invention.
Figure 4:
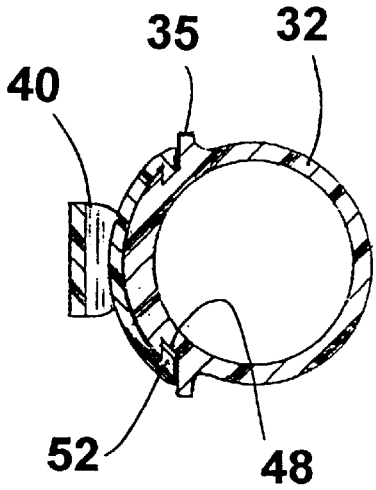
FIG. 4 is a cross-sectional top view of the strap hook of the invention.
Figure 5:
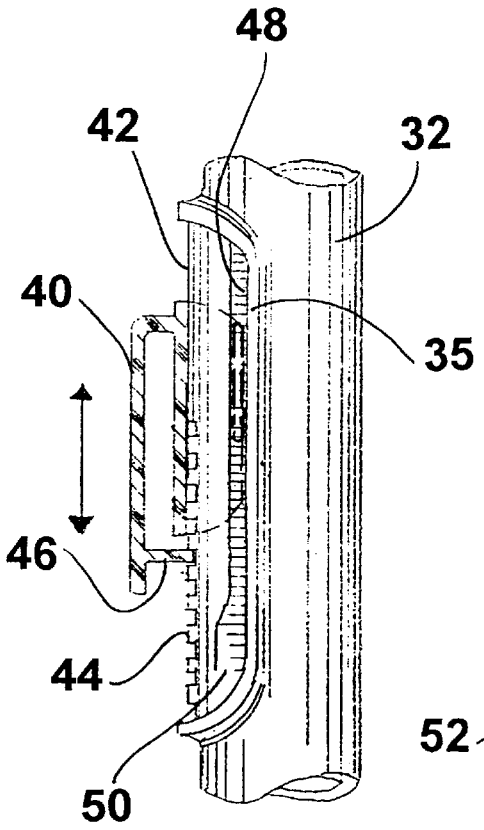
FIG. 5 is a side, partially cross-sectional view of the hook strap and snorkel tube.
Figure 6:
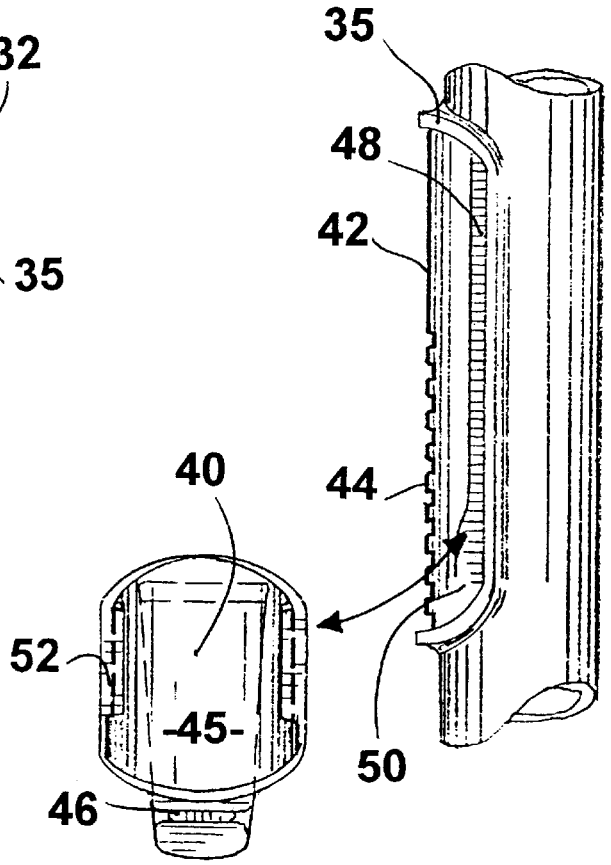
FIG. 6 is an exploded view of the strap hook and slide region of the snorkel tube of the invention.

Referring first to prior art FIGS. 1 and 2, it will be seen that a conventional snorkel 10 comprises a snorkel tube 12 having an opening 14 at one end and being connected through a flexible portion 18 to a mouthpiece 16 at another end. A strap hook 20 is slidably connected to tube 12 by a hook retainer 22 which is formed of a flexible plastic and has a gap 24 which permits removal of the strap hook from the tube. As previously described, strap hook 20 is easily inadvertently separated from tube 12 when a sufficient force is exerted to open gap 24 until retainer 22 opens to a dimension comparable to the diameter of tube 12. Furthermore, because retainer 22 may readily slide along tube 12, it often needs to be readjusted so that the mouthpiece 16 remains a desired distance below strap hook 20.

Turning to the remaining FIGS. 3 through 6, it will be seen that a snorkel 30 comprises a tube 32 having an opening 34 at one end and is connected through a flexible portion 38 to a mouthpiece 36 at the other end. However, unlike the prior art snorkel of FIGS. 1 and 2, snorkel 30 comprises a slide border 35 forming a hook slide region 42. This region receives a strap hook 40 having a curved hook slide 45 having a pair of rails 52. Rails 52 are normally received in a dove tail arrangement by parallel recesses 48.

The lower ends of recesses 48 terminate above the lower end of slide border 35 to form a pair of openings 50 to permit selective removal of the strap hook 40 from tube 32. A plurality of aligned teeth 44 are provided along a center area of hook slide region 42 and strap hook 40 is provided with a semi-flexible catch 46 which nominally engages teeth 44 to control the slide position of the hook slide 45 along the hook slide region.

When it is desired to adjust the position of strap hook 40, catch 46 is pulled away from teeth 44 and hook slide 45 may be slid in either direction along hook slide region 42. When it is desired to remove strap hook 40 from the snorkel 30, catch 46 is pulled away from teeth 44 and hook slide 45 is slid down until rails 52 exit recesses 48 through openings 50. However, with catch 46 engaging teeth 44 and rails 52 in recesses 48, strap hook 40 cannot be slid along or removed from tube 32 and thus does not suffer the disadvantages of the prior art snorkel.

Having thus described a preferred embodiment of the invention, it being understood that numerous additions, modifications and variations are contemplated and will now be apparent to those having the benefit of the above disclosure, what is claimed is:

1. A snorkel having an elongated tube terminating in an opening at one end and a mouthpiece at another end, the snorkel comprising:

a strap hook assembly having a strap hook having a catch and a pair of rails, said assembly also having a slide region on said elongated tube, said slide region having a pair of recesses for receiving said rails in slidable engagement which is resistant to radial detachment of said rails from said recesses except at a unitary location;

said slide region having a plurality of teeth for receiving said catch to prevent sliding of said strap hook.

2. The snorkel assembly recited in claim 1 wherein said catch is semi-flexible to permit selective withdrawal of said catch from said teeth for sliding said strap hook along said slide region.

3. The snorkel assembly recited in claim 1 wherein said slide region is substantially surrounded by a border.

4. The snorkel assembly recited in claim 1 wherein said recesses terminate at said unitary location to permit selective detachment of said strap hook from said slide region.

5. The snorkel assembly recited in claim 1 wherein said rails and said recesses are slidably engaged by a dove tail relationship.

6. A snorkel having an adjustable strap hook engaging a slide region along an elongated tubular portion of the snorkel; the snorkel having a strap hook assembly comprising:

a pair of rails of said strap hook and said tubular portion having a pair of recesses receiving said rails in a dove tail sliding engagement for permitting a change in location of said strap hook along said tubular portion.

7. The snorkel assembly recited in claim 6 said tubular portion further comprising a slide region having a plurality of sequential teeth, said strap hook having a semi-flexible catch for engaging said teeth to prevent inadvertent change in location of said strap hook along said tubular portion.

8. The snorkel assembly recited in claim 6, wherein said recesses have at least one opening along said tubular portion for selective release of said strap hook from said tubular portion when said rails are removed from said recesses through said at least one opening.

* * * * *